United States Patent [19]

Lasley

[11] Patent Number: 4,934,603

[45] Date of Patent: Jun. 19, 1990

[54] HAND HELD ELECTROSTATIC SPRAY GUN

[75] Inventor: Charles T. Lasley, Toledo, Ohio

[73] Assignee: The DeVilbiss Company, Toledo, Ohio

[21] Appl. No.: 330,152

[22] Filed: Mar. 29, 1989

[51] Int. Cl.[5] ..... B05B 5/025

[52] U.S. Cl. ..... 239/527; 239/707; 239/528

[58] Field of Search ..... 239/525, 526, 527, 528, 239/690, 704–707

[56] References Cited

U.S. PATENT DOCUMENTS

| | | | |
|---|---|---|---|
| 2,553,848 | 5/1951 | Dalrymple | 239/527 |
| 2,829,006 | 4/1958 | Johansson | 239/526 |
| 3,589,621 | 6/1971 | Bradley | 239/526 |
| 4,598,871 | 7/1986 | Hartle | 239/706 |
| 4,750,676 | 6/1988 | Huber et al. | 239/705 |
| 4,752,034 | 6/1988 | Kuhn et al. | 239/690 |

*Primary Examiner*—Andres Kashnikow
*Assistant Examiner*—Karen B. Merritt
*Attorney, Agent, or Firm*—MacMillan, Sobanski & Todd

[57] ABSTRACT

A hand held spray gun including a gun body, a barrel and a nozzle assembly attached to the front of the barrel. A tubular retainer passes through a portion of the body and is threaded into a passage in the barrel to connect the barrel to the body. A fluid valve actuator extends from the body through the retainer and into the barrel passage for operating a fluid valve in the nozzle assembly. The retainer also functions as a guide for the valve actuator, holds a radial fluid seal for forming a sliding seal against the valve actuator and serves as a stop for a spring biased fluid seal between the valve actuator and the barrel.

5 Claims, 3 Drawing Sheets

HAND HELD ELECTROSTATIC SPRAY GUN

TECHNICAL FIELD

The invention relates to spray painting and more particular to an improved hand held electrostatic paint spray gun.

BACKGROUND ART

In certain designs of hand held spray guns, the gun includes a body and a barrel which are attached together in a manner which permits removal of the barrel from the body. The barrel may be removed from the body for various reasons. For example, it may be necessary to disassemble the spray gun for major cleaning of internal fluid passages and/or for replacement of worn parts. In hand held electrostatic spray guns, at least a portion of the high voltage power supply may be located in a chamber extending between the barrel and the gun body. Disassembling the barrel from the body provides access for servicing such power supply components. Further, U.S. Pat No. 4,598,871 teaches that an electrostatic spray gun can be provided with multiple barrels for adapting the gun to different coating applications. One barrel and attached nozzle assembly is designed for air atomization of paint. Another barrel and nozzle assembly is designed for hydrostatic or airless atomization of paint and still a third barrel and nozzle assembly may be designed for applying fluidized powder coatings. In the spray gun shown in this patent, all air and fluid connections are made directly to the barrel and do not go through the gun body. A fluid valve actuator on each barrel is located to engage a trigger on the gun body. A high voltage cable projecting from the gun body extends into and makes electrical contact with components in the attached barrel.

To reduce the weight and the pull from hoses attached to the barrel end of the gun and to improve the balance of the gun, it is preferable to have the electrical supply cables and at least the air supply hose connected to the gun handle. Various connections must be made between the barrel and the body of a spray gun. A manually actuated trigger typically is mounted on the gun body. When actuated, the trigger moves a needle in an axial direction to open a fluid valve located in the gun barrel. Depending on the design and construction of the spray gun, electrical connections and/or compressed air and/or coating liquid passages must extend from the gun body to the barrel. The manner in which the barrel is removably attached to the gun body is critical to prevent air and liquid leakage and to maintain continuity of electrical connections and electrical insulation. Also, the design must facilitate servicing components mounted in the barrel and in the gun body.

DISCLOSURE OF INVENTION

According to the invention, an improved hand held spray gun is constructed to provide a solid connection between the gun body and the barrel. The barrel is easily removed from the gun body to facilitate servicing the barrel and components mounted inside the barrel and the gun body.

The barrel is connected to the gun body at two points. Adjacent the top of the gun, a bolt connects the body and barrel together. A tubular retainer also extends through a lower portion of the body and is threaded into the barrel. The retainer serves several functions. First, the retainer forms the second connection between the body and the barrel. The retainer also guides a trigger actuated valve needle in the barrel and holds a radial seal which permits the needle to slide in an axial direction without fluid leakage between the needle and the retainer.

Details of the invention are described in the following specification with reference to the accompanying drawings.

BEST MODE FOR CARRYING OUT THE INVENTION

Figure 1:
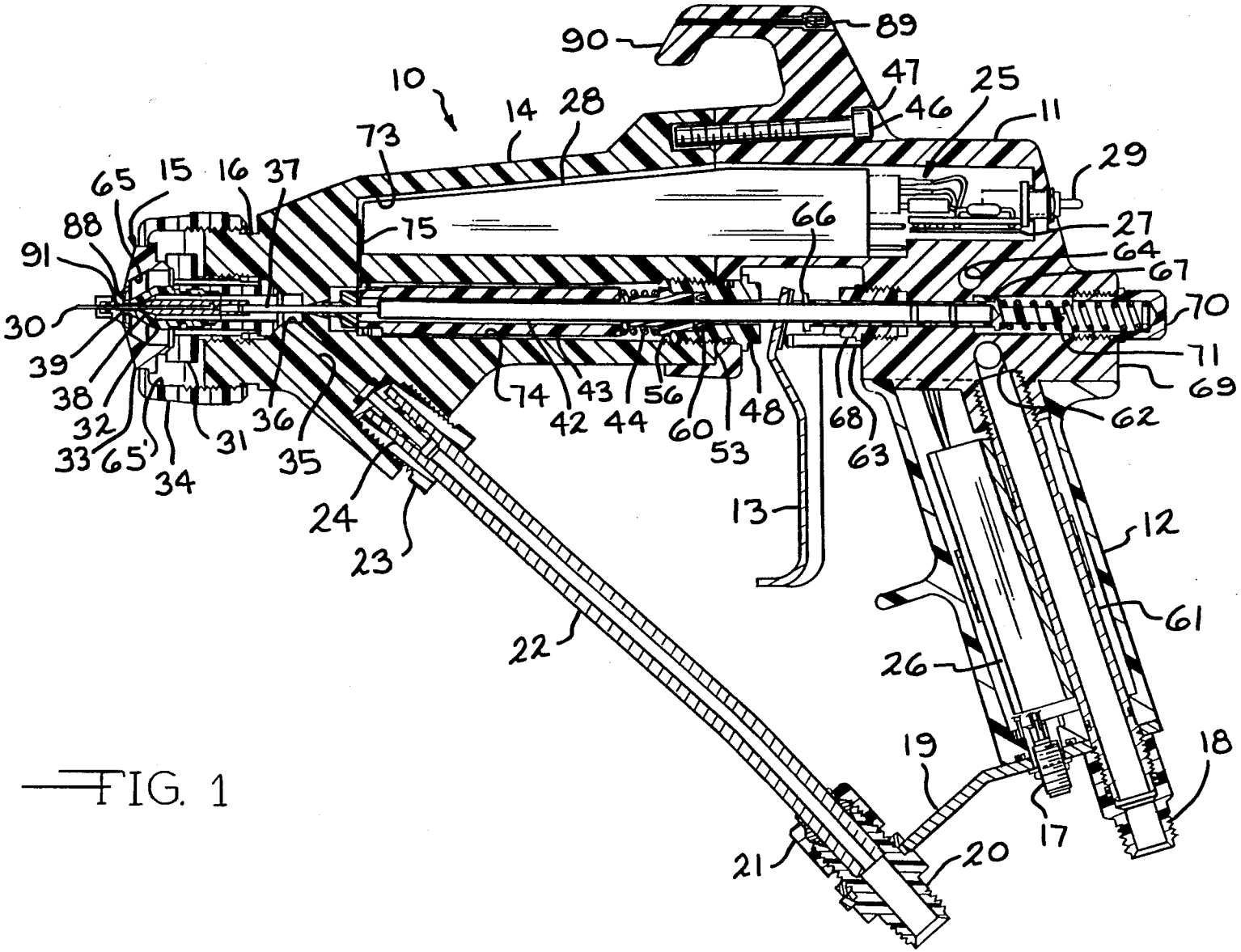
FIG. 1 is a cross sectional view through a hand held electrostatic spray gun according to a preferred embodiment of the invention.

Referring to FIG. 1 of the drawings, a spray gun 10 embodying the invention is shown in cross section. The spray gun 10 generally includes a body 11 having a handle 12, a trigger 13 and a barrel 14 attached thereto. A nozzle assembly 15 is attached to an end 16 of the barrel 14. At the lower end of the gun handle 12, a connector 17 receives electrical power from a suitable external power source (not shown) and compressed air is applied to a fitting 18 from a suitable source (not shown). A bracket 19 attached to the handle 12 supports a fluid fitting 20 and one end 21 of a tube 22. An adapter 23 is threaded into the barrel 14 to attach the other end 24 of the tube 22 to the barrel 14. A coating material supply hose (not shown) is attached to the fluid fitting 20 for supplying paint or other coating material through the tube 22 to the barrel 14. The tube 22 and the bracket 19 place the connection to the coating material supply hose closer to the handle 12 to provide better balance to the gun 10 and also to eliminate strain from the relatively heavy material supply hose from the barrel 14.

The electrical connector 17 receives a low voltage direct current for driving an internal high voltage power supply 25. In the illustrated spray gun 10, the high voltage power supply 25 comprises an oscillator module 26, a switching module 27 and a voltage multiplier module 28. The oscillator module 26 converts the low voltage direct current to an alternating current. The switching module 27 turns the oscillator module 26 on and off under the control of a manual switch 29. The switching module 27 limits the voltage and the current available at the switch to a sufficiently low level to prevent arcing which could ignite flammable paint solvent fumes. The alternating current output from the oscillator module 26 is applied to a voltage step-up transformer (not shown) either in the oscillator module 26 or in the voltage multiplier module 28 to produce an intermediate voltage alternating current. The intermediate voltage alternating current is rectified and multiplied in the voltage multiplier module 28 to a very high voltage direct current, for example between 20,000 and 80,000 volts dc. As will be described in greater detail below, the high voltage output from the voltage multiplier module 28 is applied to an electrode 30 which projects from the nozzle 15. In a modified embodiment of the spray gun 10, the internal power supply 25 can be replaced with an external power supply (not shown) which is connected through a high voltage cable and a large series resistor through the spray gun handle 12, the body 11, and the barrel 14 and thence to the electrode 30.

Figure 6:
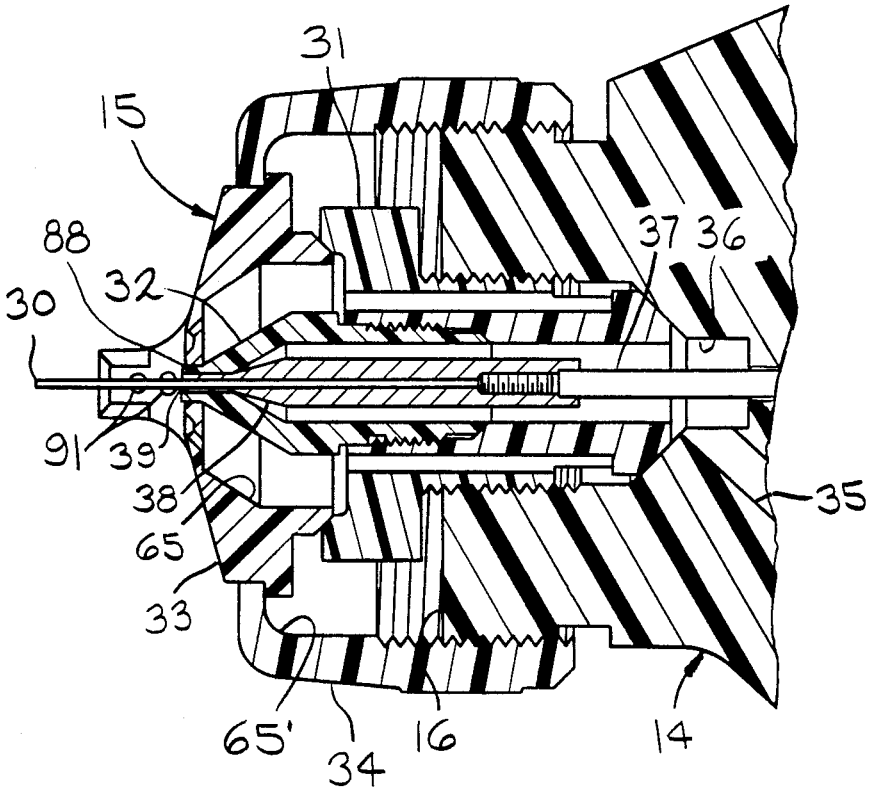
FIG. 6 is an enlarged fragmentary cross sectional view of the nozzle assembly for the spray gun of FIG. 1.

As shown in FIGS. 1 and 6, the nozzle assembly 15 includes a fluid nozzle 31 which is threaded into the barrel 14, a fluid tip 32 which is threaded into the fluid nozzle 31, an air cap 33 which is positioned over the fluid tip 32 and the fluid nozzle 31, and a retainer ring 34 which is threaded on the barrel end 16 to retain the air cap 33 on the barrel 14. Paint received from the fitting 20 and the tube 22 flows through a passage 35 in the barrel 14 to a chamber 36 formed between the barrel 14, the fluid nozzle 31 and the fluid tip 32. A valve stem 37 extends into the chamber 36 and supports a valve head 38 which normally is seated against the fluid tip 32 to block a fluid discharge orifice 39. The valve head 38 is threaded onto the valve stem 37 to permit replacement of the valve head 38. The electrode 30 is mounted in the valve head 38 and extends in an axial direction through the valve head 38 to, at one end, project through the orifice 39 and, at the opposite end, to electrically connect with the valve stem 37. If desired for safety reasons, a resistor (not shown) may be located in the valve head 38 electrically in series between the electrode 30 and the valve stem 37.

Figure 2:
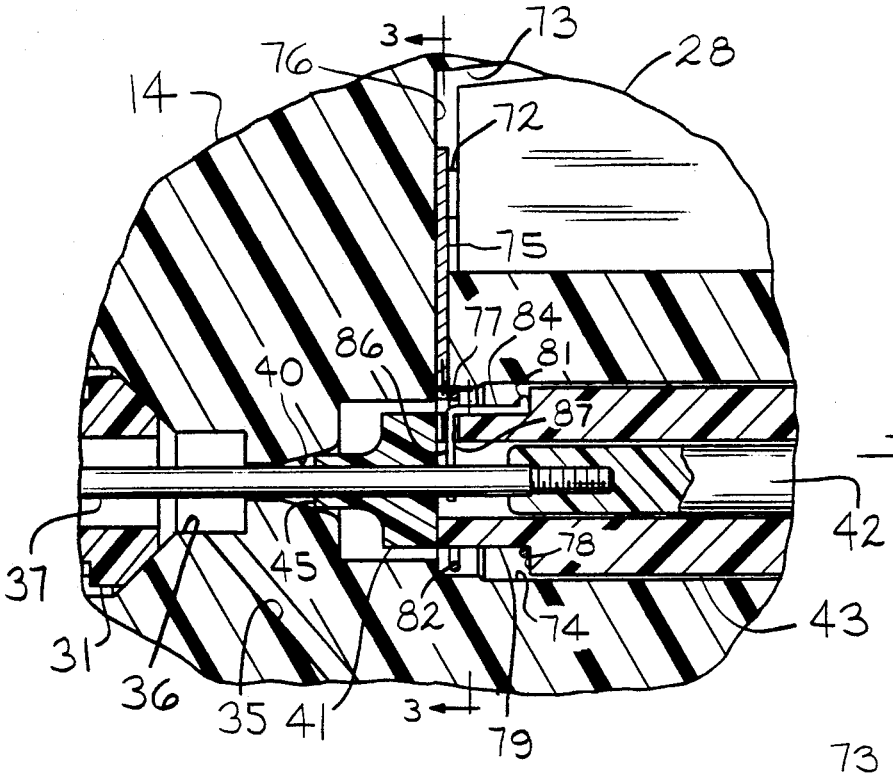
FIG. 2 is an enlarged fragmentary cross sectional view of a portion of the spray gun of FIG. 1 showing details for the electrical connection from the high voltage power supply to the trigger actuated valve needle.

As best seen in FIG. 2, the valve stem 37 extends in a rearward direction through a tapered hole 40 in the barrel and through a seal 41 and is attached to an electrically non-conducting actuator rod 42. A spacer tube 43 surrounding the actuator rod 42 is biased in a forward direction by a spring 44 (FIGS. 1 and 5) to press an annular front edge 45 on the seal 41 against the tapered hole 40 and thus form a radial fluid seal between the barrel 14 and the valve stem 37. The seal 41 is effective to prevent leakage from the chamber 36 even when high pressure paint is present in the chamber 36 and the valve stem 37 is reciprocated. Further details on the seal 41 are shown in U.S. Pat. No. 4,406,468.

Figure 5:
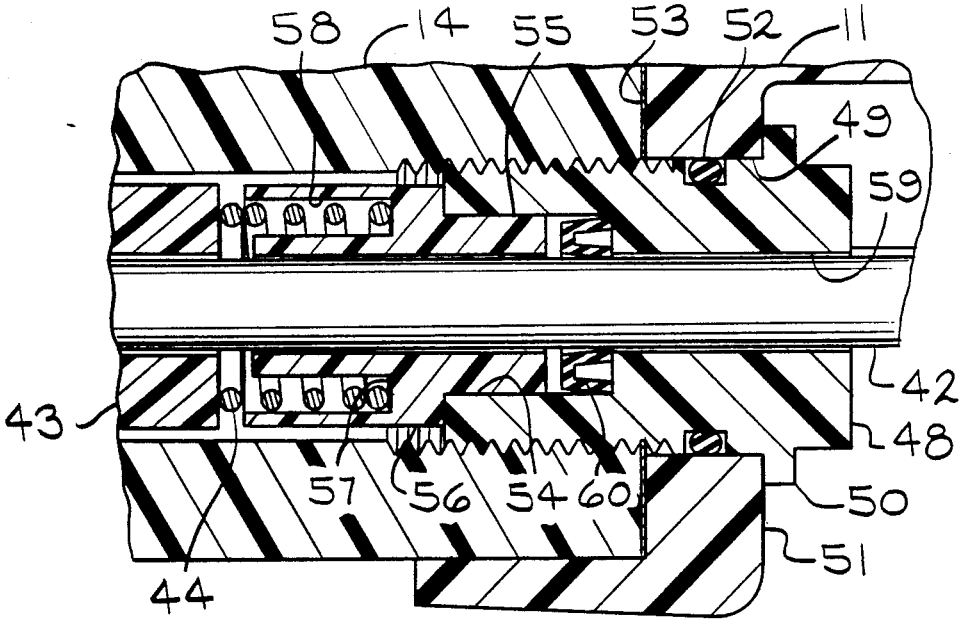
FIG. 5 is an enlarged fragmentary cross sectional view of a portion of the spray gun of FIG. 1 showing details of the seal where the valve needle enters the gun body and of the retainer which connects the gun barrel to the gun body.

The barrel 14 is attached to the body 11 at two points, as shown in FIGS. 1 and 5. A bolt or cap screw 46 inserted into a stepped opening 47 adjacent the top of the body 11 is threaded into the top of the barrel 14. A retainer 48 connects the bottom of the body 11 to the barrel 14. The retainer 48 serves several functions. The retainer is passed through an opening 49 through the body 11 and threaded into the barrel 14 until a shoulder 50 on the retainer 48 abuts a wall 51 on the body 11. An O-ring seal 52 is located between the retainer 48 and the body 11 and a gasket 53 is located between the barrel 14 and the body 11. The seal 52 and the gasket 53 prevent liquid leakage between the retainer 48, the body 11 and the barrel 14. For additional protection against leakage, an O-ring seal (not shown) also may be located at the joint between the retainer 48, the body 11 and the barrel 14.

The retainer 48 has a stepped axial opening 54. A reduced diameter end 55 of a seat 56 is telescoped into the end of the retainer opening 54 interior to the barrel 14. The seat 56 has an annular opening 58 terminating at a bottom 57. The spring 44 is positioned coaxially in the annular opening 58 to compress between the opening bottom 57 and the spacer tube 43. The exterior wall of the opening 58 prevents the spring 44 from significantly reducing the voltage breakdown path between the high voltage valve stem 37 and the grounded electrically conductive body 11. The valve actuator rod 42 extends coaxially through the spacer tube 43, the seat 56 and the retainer 48. A portion 59 of the retainer opening 54 is sized to serve as a guide for the actuator rod 42 adjacent the body wall 51. A radial seal 60 is located in the retainer opening 54 between the retainer 48 and the seat 56 to form a fluid seal between the retainer 48 and the actuator rod 42 which permits the actuator rod 42 to slide in an axial direction.

As shown in FIG. 1, the air fitting 18 on the handle 12 is attached to a tube 61 which extends through the handle 12 and is threaded into a passage 62 in the body 11. The tube 61 and the fitting 18 retain the handle 12 on the body 11. The trigger 13 is mounted on the body 11 to pivot as it is squeezed. As the trigger 13 is squeezed, an air valve actuator 63 is pushed to open an air valve (not shown) to connect the passage 62 to a passage 64. The passage 64 is connected through passages (not shown) in the body 11 and the barrel 14 to chambers 65 and 65' in the nozzle assembly 15 between the barrel 14, the fluid nozzle 31, the fluid tip 32, the air cap 33 and the retainer ring 34.

As the trigger 13 is further squeezed, it engages a plunger 66 which is retained on the actuator rod 42. The plunger 66 is supported and guided for axial movement in an opening 67 through the body 11 by a bushing 68. At the rear 69 of the body 11, a spring retainer cap 70 is threaded into the opening 67. A return spring 71 is positioned between the retainer cap 70 and the plunger 66. When the trigger 13 is released, the spring 71 moves the plunger 66 and the attached actuator rod 42 forward to seat the valve head 38 against the fluid tip 32 and interrupt the flow of paint.

To prevent grounding of the high voltage the barrel 14 is made from an electrically non-conducting synthetic resinous material. For safety reasons, the body 11 and the handle 12 are made from an electrically conducting synthetic resinous material. It is necessary to maintain a direct electrical connection between the high voltage output at a terminal 72 (FIG. 2) on the high voltage module 28 and the electrode 30 as the actuator rod 42 is moved by the trigger 13 to open the fluid valve. Referring to FIGS. 1–4, details are shown for the electrical connection. The high voltage module 28 is located in a chamber 73 which extends between the barrel 14 and the body 11. In the barrel 14, the actuator rod 42, a portion of the valve stem 37 and the spacer tube 43 are located in a stepped bore 74 extending through the barrel 14. An electrical conductor wire 75 is embedded in the electrically insulating barrel 14 to extend from a front end 76 of the chamber 73 to a step 77 in the bore 74. When the high voltage module 28 is located in the chamber 73, the high voltage terminal 72 contacts the wire 75.

Figure 4:
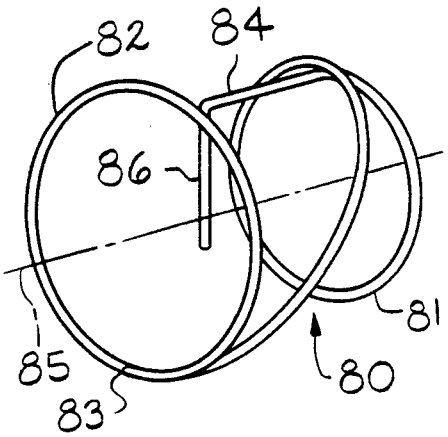
FIG. 4 is an enlarged perspective view of the spring which establishes a sliding electrical contact with the trigger actuated valve needle.

The spacer tube 43 has a radial step 78 and a reduced diameter end 79 adjacent the seal 41. A contact spring 80 establishes a continuous electrical connection between the wire 75 and the metal valve stem 37 as the valve stem 37 is reciprocated in an axial direction by the trigger 13. As best seen in FIG. 4, the spring 80 is in the general form of a modified helix extending between a first or rear end loop 81 and a second or forward end loop 82. The second or forward end loop 82 is slightly larger in diameter than the first end loop 81. The spring 80 has an end 83 terminating at the second loop. From the rear end loop 81, the spring 80 has a side 84 extending forward in a direction parallel to the axis 85 of the spring 80. From the side 84, the spring 80 has a side 86 extending radially inwardly past the axis 85. The smaller rear end loop 81 on the spring 80 is sized to engage and retain the spring 80 on the spacer tube end 79 with the loop abutting the tube step 78. When the rear end loop 81 is positioned on the spacer tube 43, the spring side 84 extends forward along the tube end 79 and the spring side 86 projects radially inwardly through a radial hole 87 through the tube end 79.

Figure 3:
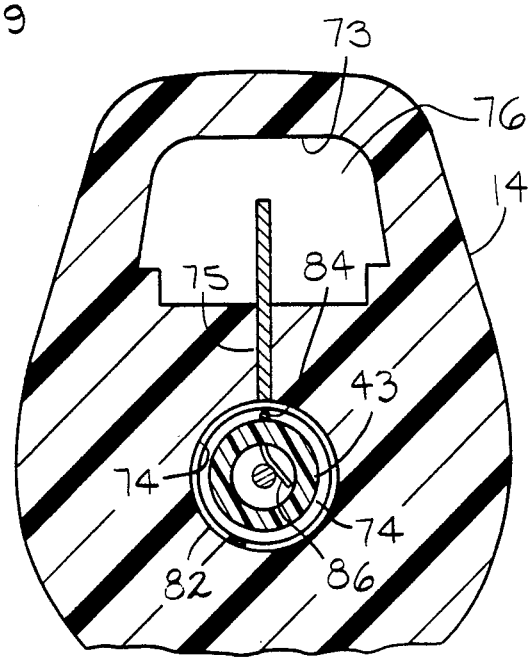
FIG. 3 is a cross sectional view taken along line 3—3 of FIG. 2.

The enlarged diameter forward loop 82 on the spring 80 presses against the wire 75 at the step 77 in the barrel bore 74 to establish an electrical connection between the spring 80 and the high voltage power supply terminal 72. At the same time, the radially directed spring side 86 is deflected to one side by and presses against the valve stem 37, as shown in FIG. 3. Thus, a good electrical connection is established between the wire 75 and the valve stem 37 regardless of the rotational position of the spring 80 and the spacer tube 43 and regardless of the axial position of the valve stem 37. Since the electrode 30 either extends through the valve head 38 and contacts the valve stem 37 or may be connected through a resistor (not shown) in the valve head 38 to the valve stem 37, a continuous electrical connection is maintained between the output contact 72 of the high voltage module 28 and the electrode 30.

After compressed air is applied to the fitting 18, power is applied to the connector 17 and paint or other coating material is supplied to the fitting 20, the spray gun is operated by turning on the switch 29 to turn on the high voltage power supply 25 and squeezing the trigger 13. Optionally, a neon glow tube 89 may be mounted in a gun hanger 90 which is integral with the body 11. When the high voltage is turned on, the electrostatic field surrounding the gun 10 is sufficient to cause the tube 89 to glow to inform the operator that the power supply is on and properly operating. As the trigger is progressively squeezed, atomization air is applied to the nozzle chamber 65 and, if a fan shaped spray pattern is desired, pattern shaping air is applied to the chamber 65'. A separate valve (not shown) may be provided in the gun body 11 to adjust or to totally interrupt the delivery of pattern shaping air to the chamber 65' when the trigger 13 is squeezed. The atomization air flows from the chamber 65 through an annular orifice 88 which is located between the fluid tip 32 and the air cap 33 and surrounds the paint discharge orifice 39. Further movement of the trigger 13 causes the actuator rod 42 to move to separate the valve head 38 from its seat against the fluid tip 32, allowing paint to flow from the orifice 39. As the paint is discharged from the orifice, it is atomized by air discharged from the orifice 88 to form a round expanding pattern and it is charged by the high voltage electrode 30. If a fan shaped pattern is desired, air is delivered to the chamber 65' and discharged from orifices 91 on diametrically opposite sides of the orifice 39 to shape the pattern of the atomized paint.

It will be appreciated that various modifications and changes may be made in the above described preferred embodiment of the spray gun 10 without departing from the spirit and the scope of the following claims.

I claim:

1. A hand held spray gun comprising a body, a barrel having a first end abutting said body and a second end and having passage means for delivering compressed air and liquid to said second end, a nozzle assembly attached to said second barrel end, a fluid valve for controlling the flow of liquid from said barrel to a fluid discharge orifice in said nozzle assembly, a fluid valve actuator extending from a first passage in said body through a second passage in said barrel assembly to said fluid valve, trigger means on said body for axially reciprocating said valve actuator in said first and second passages to open and close said fluid valve, said second passage having internal threads adjacent said first barrel end, a tubular retainer passing through a portion of said first passage and into said second passage at said first barrel end, said retainer having an enlarged diameter portion engaging said body and having a threaded end engaging said internal threads in said second passage whereby said retainer connects said first barrel end to said body, said valve actuator passing coaxially through said retainer, a tubular spacer located in said second passage, said valve actuator passing coaxially through said spacer, spring means urging said spacer towards said nozzle assembly, and seal means in said second passage adjacent said first end responsive to the force on said spacer for forming a fluid seal between said barrel and said valve actuator while permitting said valve actuator to reciprocate.

2. A hand held spray gun, as set fort in claim 1, wherein said tubular retainer has an axial opening sized to guide said valve actuator when said valve actuator is reciprocated by said trigger means.

3. A hand held spray gun, as set forth in claim 1, wherein said spring means comprises a compression spring located between said retainer and said spacer.

4. A hand held spray gun, as set forth in claim 3, and further including a radial fluid seal between said retainer and said valve actuator, and means for holding said radial seal in said retainer.

5. A hand held spray gun, as set forth in claim 4, wherein said means for holding said radial seal in said retainer includes said spring.

* * * * *